US007931785B2

(12) United States Patent
Ishmukhametov et al.

(10) Patent No.: US 7,931,785 B2
(45) Date of Patent: Apr. 26, 2011

(54) METHOD FOR CRACKING, UNIFICATION AND REFINING OF HYDROCARBONS AND DEVICE FOR ITS IMPLEMENTATION

(76) Inventors: Azamat Zaynullovich Ishmukhametov, Ufa (RU); Valentin Panteleymonovich Smirnov, Moscow (RU); Vitaliy Mikhaylovich Nistratov, Moscow (RU); Sergey Leonidovich Nedoseev, Moscow (RU)

( * ) Notice: Subject to any disclaimer, the term of this patent is extended or adjusted under 35 U.S.C. 154(b) by 152 days.

(21) Appl. No.: 12/265,031

(22) Filed: Nov. 5, 2008

(65) Prior Publication Data

US 2010/0108492 A1 May 6, 2010

(51) Int. Cl.
*C10G 15/08* (2006.01)

(52) U.S. Cl. ..... 204/172

(58) Field of Classification Search ..... 204/172
See application file for complete search history.

(56) References Cited

U.S. PATENT DOCUMENTS 3,836,344 A * 9/1974 Krawitz et al. ..... 48/211
6,159,432 A * 12/2000 Mallinson et al. ..... 422/186.04
6,896,854 B2 * 5/2005 Kong et al. ..... 422/186.3
2003/0233019 A1 * 12/2003 Sherwood ..... 585/943
2005/0189212 A1 * 9/2005 Morton ..... 204/157.15

FOREIGN PATENT DOCUMENTS

RU 2252069 2/2005
WO 2005/009607 2/2005
WO 2007/070698 6/2007

* cited by examiner

*Primary Examiner* — Kishor Mayekar
(74) *Attorney, Agent, or Firm* — Boris Leschinsky

(57) ABSTRACT

A method for cracking a heavy hydrocarbon is described including exposing a heterogeneous medium of the heavy hydrocarbon with a hydrogen-containing gas in a chamber to both an electronic beam and an electric discharge field at the same time so as to create a thermal non-equilibrium as well as a spatially non-uniform state for this medium. Such dual exposure allows the cracking method to proceed without high temperature and high pressure typically required therefore and thus reduces the energy consumption and impurities generated along with desirable output product. Refining of hydrocarbons is achieved by removing sulfur therefrom during cracking in the form of hydrogen sulphide. A reverse use of this method is also described, namely a unification method for light fractions to be transformed into a heavy hydrocarbon.

25 Claims, 2 Drawing Sheets

METHOD FOR CRACKING, UNIFICATION AND REFINING OF HYDROCARBONS AND DEVICE FOR ITS IMPLEMENTATION

BACKGROUND OF INVENTION

The present invention concerns with oil, gas, petrochemical, coal and other industries, and specifically has to do with processing of heavy hydrocarbon materials (e.g. high-molecular-weight materials like crude oil, coal, etc.) for obtaining their light fractions having a low molecular weight (e.g. benzene, kerosene, fuels, etc. or getting liquid fuels from coal), typically by cracking or other types of converting of hydrocarbons.

The invention also addresses the issues of purification (e.g., removing sulfur contamination) from the treated hydrocarbon product during the cracking process. The most commonly used term for describing the process of treating raw hydrocarbon and its conversion into lighter, higher octane number components is refining. Petroleum refining has evolved continuously in response to changing consumer demand for new and better products. The original requirement was simply to produce kerosene as a cheaper and better source of light than whale oil. The development of the internal combustion engine led to the production of gasoline and diesel fuels. The evolution of the airplane first created a need for high-octane aviation gasoline and then for jet fuels, a much more sophisticated form of the original product, kerosene. Present-day refineries produce a variety of products including many required as initial materials for the petrochemical industry.

There are a few primary technologies that address the above needs. They include distillation, thermal cracking, catalytic conversion, and various other treatments. Of these, thermal cracking is considered to be the most efficient and universal technology, and it is commonly and broadly used for converting heavy high-molecular-weight hydrocarbons into lighter lower-molecular-weight fractions.

The objective of cracking hydrocarbons is to maximize output of desirable lower-molecular-weight products having minimum contaminants, while at the same time reducing power consumption. Advanced technologies of cracking high-molecular-weight hydrocarbons (e.g., heavy crude oil with high sulfur content or bitumens) attract significant attention worldwide.

In petroleum geology and chemistry, cracking is the process whereby complex organic molecules such as kerogens or heavy hydrocarbons are broken down into simpler molecules (e.g. light hydrocarbons) by the breaking of carbon-carbon bonds in the precursors. The rate of cracking and the end products in the traditional processes are strongly dependent on the temperature and presence of any catalysts. Cracking, also referred to as pyrolysis, is the breakdown of a large alkane into smaller, more useful alkenes and an alkane. Simply put, cracking hydrocarbons is breaking long chain hydrocarbons up into short ones.

Modern high-pressure thermal cracking operates at absolute pressures of about 7,000 kPa. An overall process of disproportionation can be observed, where light, hydrogen-rich fractions are formed at the expense of heavier molecules which condense and are depleted of hydrogen. The actual reaction is known as homolytic fission and produces alkenes, which are the basis for the economically important production of polymers.

A large number of chemical reactions take place during cracking, most of them based on free radicals. Computer simulations aimed at modeling what takes place during cracking have included hundreds or even thousands of reactions in their models. The main reactions that take place include:

- Initiation reactions, where a single molecule breaks apart into two free radicals. Only a small fraction of the feed molecules actually undergo initiation, but these reactions are necessary to produce the free radicals that drive the rest of the reactions. Initiation usually involves breaking a chemical bond between two carbon atoms, rather than the bond between a carbon and a hydrogen atom.
- Hydrogen abstraction, where a free radical removes a hydrogen atom from another molecule, turning the second molecule into a free radical.
- Radical decomposition, where a free radical breaks apart into two molecules, one an alkene, the other a free radical. This is the process that results in the alkene products of cracking.
- Radical addition, the reverse of radical decomposition, in which a radical reacts with an alkene to form a single, larger free radical. These processes are involved in forming the aromatic products that result when heavier feedstocks are used.
- Termination reactions, which happen when two free radicals react with each other to produce products that are not free radicals. Two common forms of termination are recombination, where the two radicals combine to form one larger molecule, and disproportionation, where one radical transfers a hydrogen atom to the other, giving an alkene and an alkane.

Presently known and commonly used petrochemical technologies of cracking hydrocarbons or getting liquid fuels from coal require high temperature, high pressure, and consumption of expensive short-lived catalysts. Thus, processes that occur in the reaction chamber are very difficult if not impossible to control. Besides, additional undesirable processes, such as polymerization, polycondensation and coking, usually accompany the cracking process. All presently existing technologies require high power consumption and are therefore expensive. Because of that, they are mostly practiced by only a few large-scale manufactures. Traditional petrochemical refinery plants are quite complex and occupy large territories. All above factors considerably limit usage of thermal cracking as a universal and cost-efficient technology.

One of the major factors affecting development of the world petroleum industry is the growing production of heavy oil having adverse physical and chemical properties (high viscosity, high boiling point, presence of undesirable contaminating substances, such as sulfur or others). Economically justified technologies for development of these resources have a very high strategic value for USA, Canada, Latin America, Middle East, Russia and other countries around the world. Here are a couple of typical examples of critical issues with oil processing:

- It is highly advantageous to process heavy crude oil immediately after it's being produced, preferably at or near the well site, in order to reduce oil viscosity, density, sulfur contamination, etc. before transportation via pipelines. Otherwise, the ultimate cost of the final hydrocarbon product becomes very high;
- At the entry of a petrochemical (refinery) plant it is often necessary, depending on properties of the raw input material, to modify crude product properties by some alteration of its chemical composition with the goal of increasing the content of saturated or non-saturated hydrocarbons, depending on specific requirements for further distillation process.

Existing technologies of making liquid fuels from coal (e.g., gasification of coal or direct hydrogenation) require significant heating and high pressure. They are usually multi-cycle and high energy-consuming processes. Besides, these processes are very difficult to control and produce significant amounts of ecologically harmful waste.

All known methods of thermal cracking require continuous generation of free radicals—initiators of chain reactions. They require high temperature/high pressure environment and consume high dozes of the absorbed energy. This reduces efficiency of these methods and does not allow effective control of the process. Furthermore, some secondary detrimental processes (e.g., polymerization or coking) occur in the reaction chambers in most of the known technologies, which further reduces their value.

These known issues with the existing hydrocarbon cracking technologies prompt scientists and engineers worldwide to continue their search for new methods that are free of these disadvantages or they are less pronounced. The following is a brief summary of the related prior art that is published or otherwise publicly disclosed.

It is known in the art that under influence of ionizing radiation, both γ-rays and β-radiation, hydrocarbon molecular' destruction and polycondensation take place. In this case, the process development and resulting products depend significantly on the temperature and the absorbed doze of radiation that, in turn, determine a particular ratio between the pure thermal and combined thermal-radiation exposure during a cracking process of initial fractions (see for example Mustafiev I I Radiation-Thermal transformations of heavy oil and organic portion of petro-bitumen formation. "Chemistry of High Energies", v. 24, No. 1, 1990, p. 22-26).

Another known technique is Electron-Radiation Thermal Cracking (ERTC). It is proposed for treatment and refining of oil and other hydrocarbon materials with the boiling temperature above 450° C. When such products are affected and treated by the beam of accelerated electrons, or Electron Beam (EB), with the energy of 1 to 4 MeV under atmospheric pressure and the temperature within the range of 400-410° C., the output of the desired end product increases significantly. In this case, the absorbed radiation dose is usually in the range from about 1 kGy to 10 kGy, kGy stands for kilo-Gray, a unit of the rate of radiation absorption, 1 Gray equals 1 joule per kilogram of mass. The efficiency of this process remains almost the same when the absorbed dose is increased above this range. The ERTC method was further modified: EB was proposed to be used to generate free radicals in the fluid; they, in turn, initiate chain reactions of heavy high-molecular-weight hydrocarbons' destruction (see Topchiev A V, Polak L S, Chernyak R Y, etc. // Academy of Science, USSR, 1960, v. 130, p. 789). This modified version of ERTC is more effective at lower temperatures of the liquid phase, and it does not require catalysts (see SELF-SUSTAINING CRACKING OF HYDROCARBONS, International patent publication No. WO 2007/070698).

It is also known that in a gas phase it is possible to create electric discharges, during which various plasma-chemical reactions take place. For supporting non-equilibrium plasma-chemical processes that occur at lower temperatures, the use of electric discharges with a low degree of gas ionization are of the primary interest. An example of this is sub-microsecond pulse-frequency corona discharges that take place in gases and liquids as described by Piskarev I M, Ushkanov V A, Selemir V D, etc. "Mixing a liquid under influence of a nanosecond corona high-current electric discharge", Scientific eMagazine <<Researched in Russia>>.

Another example of the prior art methods is a non-self-sustaining electric discharge occurring in a gas affected by an external ionizer of a very high intensity, such as an Electron Beam. An electric field of high intensity superimposed on the gas that, in turn, is exposed to the EB multiplies a number of electrons generated due to EB, and creates an electric discharge, which generates chemically active particles. Numerous applications of these discharges in homogeneous media are well known (e.g., for activating gas lasers). For example, chemical activity of an electric discharge supported by EB in a homogeneous gas is described in Y N Novoselov, V V Ryzhov, A I Suslov // Letters in Journal of Theoretical Physics, 1998. v. 24. No. 19; p. 41.

All of the above mentioned references are incorporated herein in their entirety by reference.

Once the basics of the cracking method are established, it can usually be used in reverse, namely to unify light fractions of hydrocarbons into a heavy hydrocarbon.

Therefore there is a need for an improved thermal cracking process allowing reducing energy consumption and reducing production of contaminants along with the desired product.

SUMMARY OF THE INVENTION

Accordingly, it is an object of the present invention to overcome these and other drawbacks of the prior art by providing a novel method for cracking a heavy hydrocarbon into its light fractions without the need to reach traditional high temperatures and high pressures associated with such cracking methods.

It is another object of the present invention to provide a novel cracking method with reduced energy consumption and reduced production of contaminants along with the desired product.

It is a further object of the present invention to provide a unification method for combining light fractions of hydrocarbons into a heavy hydrocarbon.

It is a further yet object of the present invention to provide a method of refining or purification of hydrocarbons by removing sulfur therefrom in the form of hydrogen sulphide during the process of cracking thereof.

The proposed method of cracking high-molecular-weight hydrocarbons (alternatively called "heavy hydrocarbons") into lower-molecular-weight fractions ("light fractions") can be used with different types of hydrocarbon materials as an input product, depending on a desired output (processed) product. Examples of these input products are crude oil, coal, including that in a powdered form, other hydrocarbons in a liquid or semi-liquid form with the boiling temperature point usually being above 350 C.

Another way to characterize the input heavy hydrocarbon is by a number of Carbon atoms in its structure. The method of the invention works well with heavy hydrocarbons having over 20 such Carbon atoms in their molecules.

Light fractions are characterized by having a boiling temperature point below 350 degrees C. or by having between 5 and 20 Carbon atoms in their molecular structure.

The method includes providing a heavy hydrocarbon and a hydrogen-containing gas and mixing it in a closed chamber forming a two- or three-phase medium. This medium includes at least a gas phase and a liquid phase. Due to active mixing, the liquid phase is dispersed throughout the chamber and interspersed with the gas phase. This medium is then exposed at the same time to both an electron beam and an electric discharge field to initiate and maintain chain reactions of cracking in the heavy hydrocarbon. These chain reactions of cracking cause formation of light fractions of this hydrocarbon, which are then separated and form an output product of the process.

Unlike other known methods requiring high temperature and/or high pressure for generating and maintaining chain reactions, the role of these factors in this method is noticeably reduced, so the process is very energy- and cost-efficient. Absence of high temp/pressure conditions, in turn, reduces probability of occurring of secondary undesirable reactions of polymerization, polycondensation, and coking, and it makes the entire process much more controllable.

In summary, a principally new method of cracking heavy hydrocarbons has been developed. This method includes of the following key elements:

Presence of a heterogeneous medium that consists of at least of two phases: gas phase and liquid dispersion phase;

Simultaneous exposure of this heterogeneous medium to both high energy electron beam produced by an electron accelerator and electric discharge produced by an applied high-voltage electric field, preferably applied in synch in a pulsating mode;

For the above processes, the Electron Beam primarily acts as an initiator of chain reactions and ionizer of the gas phase of the heterogeneous medium, while the Electric Discharge significantly increases the number of chain reactions' initiators and increases local volumes' non-equilibrium and heterogeneity of the system.

As a result of such combined treatment of the medium, certain non-equilibrium and non-stationary conditions of the reacting components take place, and the process of cracking heavy hydrocarbons and forming light hydrocarbon fractions becomes considerably accelerated and is more power-efficient.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENT OF THE INVENTION

Figure 1:
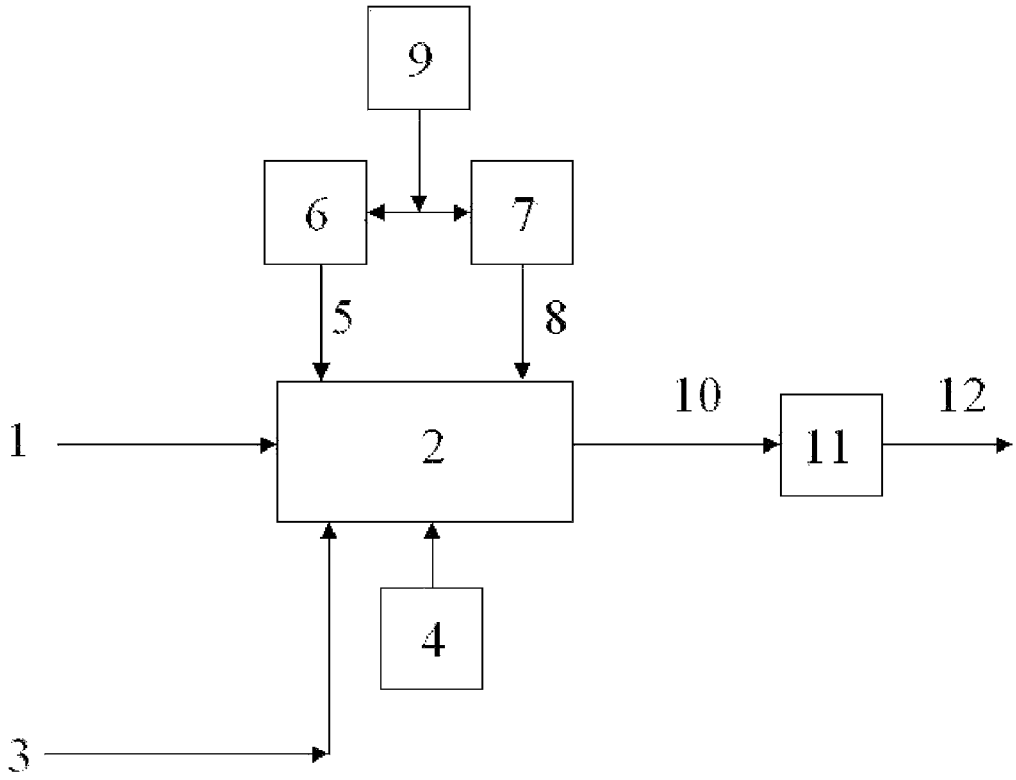
FIG. 1 is a functional block-diagram of the method.

The principal novelty of the proposed method is two-fold:

Instead of a pure gas or pure liquid, the method utilizes a chemically-active heterogeneous medium (mixture) that contains both a gas phase and a dispersed liquid and pseudo-liquid phase;

By simultaneously exposing this heterogeneous medium to both EB and Electric Discharge field, the method achieves a principally new state of that medium that opens numerous opportunities for improving the overall quality and efficiency of the process.

Electronic Beam performs two important functions in the proposed method:

1) In the volume of the gas phase characterized by a rather small density, EB does not slow down appreciably, while performing the initial ionization of the gas and thus supporting an intense electric discharge created by the applied electric field. As a result, free radicals are intensely produced. These radicals get onto the large effective surface of the liquid or pseudo-liquid phase and are absorbed by it, resulting in numerous chain reactions.

2) In the volume of the dispersion liquid phase, the density of which is thousands times greater than that of the gas phase, EB loses practically all its energy and generates free radicals for chain reactions as well. The liquid dispersion phase essentially influences the electric discharge in the gas because it changes the electric field distribution and electric conductivity within the volumetric electric discharge; it also acts as a medium for heat and volume transfer (or exchange) for the occurring gas-discharge plasma.

For given values of EB intensity and the intensity of the applied electric field, the discharge actions are defined by the density and other properties of the heterogeneous medium, such as its conductivity, dielectric permeability, and the electric durability of its liquid dispersion phase. On the one hand, the best conditions for developing and supporting the electric discharge take place in the environment with dominating gas phase (for example, micro drops of liquid in gas or the liquid stream oriented along the electric field). Since the average medium density in this case is very low, the conditions for accelerating the electrons and for efficient multiplication of their quantity in the applied electric field are quite good. On the other hand, the existing need in initiating certain chemical processes requires the presence of a heterogeneous medium with a dominating liquid or pseudo-liquid phase (for example having gas bubbles in a liquid or foam), as the conditions for electric discharge in this case are less favorable.

An important goal of the proposed method is to initiate and support non-reversible chemical transformations occurring in the treated heterogeneous medium that can not be achieved otherwise. In general, the conditions of the medium being under the dual exposure to EB and a discharge field are non-equilibrium, with high-energy electrons being in a low temperature environment.

It is known that when a medium is exposed to a stream of fast electrons with the energy in the range of MeV (radiolysis), as well as in case of gas discharges when the average energy of electrons is less than 10 eV, the "energy price" of generating chemically active particles or free radicals is very high (dozens of eV per particle). It significantly limits applications of plasma-chemical processes for large-capacity chemical plants, including petrochemistry. However, if in a heterogeneous medium that contains both gas and liquid dispersion phases appropriate conditions for developing and maintaining chain reactions are created, then the process of chemical transformations initiated by a particle becomes energetically favorable.

During chain reactions, conversion of entry crude heavy hydrocarbon products into stable light fractions products on the output occurs through a number of repeating cycles, in which intermediate particles (free radicals) play an important role. By the end of a cycle, the original active particles get restored. In theory, the chain reaction can continue until the entry product is completely used (consumed). However, in reality the chain reaction usually breaks after some time, and it's accompanied by disappearance of active particles. A very basic example of a chain reaction in gas medium is cracking of methane. The sequence of chain reactions for methane is shown in Table 1.

TABLE 1

| Chain reaction of methane cracking. | | |
|---|---|---|
| $CH_4$<-->*$CH_3$ + H* | The molecule of methane CH4 is broken up as a result of external influence (discharge, REB) on methyl radical *CH3 and atomic hydrogen radical H*. | Initiation of chain reaction |
| *$CH_3$ + $CH_4$ o-$C_2H_6$ + H* | Methyl radical *CH3 interacts with methane and produces stable ethane $C_2H_6$ and radical H*. | Continuation of chain reaction |
| H* + $CH_4$<-->*$CH_3$ + $H_2$ | Radical H * interacts with methane and produces stable hydrogen H2 and a radical *CH3. | |
| 2 H * <--> $H_2$ | Recombination of two radicals H* gives stable hydrogen. | Breakage of chain reaction |
| 2*$CH_3$ o-$C_2H_6$ | Recombination of two radicals produces stable ethane. | |
| *$CH_3$ + H*<-->$CH_4$ | Recombination of radicals *CH3 and H* produces stable methane. | |

In hydrocarbons with molecules containing numerous atoms of carbon, the chain reactions consist of a large number of simple consecutive and parallel stages. For a non-branched chain process the reaction carrier, i.e. a free radical, can either enter into a chain continuation reaction or into a chain breakage reaction. If after a chain is initiated the cycle can be re-generated v times before it "dies", then the pace of the chain continuation event is v times greater than the pace of its breakage. Therefore, the speed of a non-branched chain process Vc is equal: Vc=Vi v, where Vi—the speed of generating initiators of chain reaction. For the proposed method, this very speed Vi is increased both in gas and liquid dispersion phases of the heterogeneous medium.

The proposed method significantly enhances intensity of generating free radicals that act as initiators of chain reactions; it happens due to electric discharge in the gas phase of the heterogeneous medium. In this case, most of the above-mentioned problems associated with EB accelerators are considerably decreased or disappear. In the gas phase, the power of electric processes is primarily defined by the electric discharge. This power can significantly exceed the required power of EB, the primary function of which in this case is volumetric expansion of the electric discharge and preventing its contraction. Besides, the gas and liquid dispersion phase components of the heterogeneous medium can have completely different chemical content and molecular structure; this allows running certain advanced chemical processes that can not be realized with any of alternative existing technologies.

Method of the Invention

A detailed description of the present invention follows with reference to accompanying drawings in which like elements are indicated by like reference letters and numerals. The functional block-diagram of the method in presented in FIG. 1 and includes the following:

Step 1. Input heavy hydrocarbon product 1 is first delivered and placed into a closed chamber 2 (typically called a "reaction chamber") for subsequent treatment;

Step 2. A gas mixture 3 containing hydrogen-based and/or hydrogen-containing gases such as methane or pure hydrogen, is delivered to the same chamber. By utilizing various types of mixers 4 (barbotage, mechanical mixers, special nozzles, etc.) a mixed two- or three-phase chemically-active heterogeneous medium is formed in the chamber. This medium contains at least two phases: a gas phase and a dispersion liquid or a pseudo-liquid phase;

Step 3. This heterogeneous medium is then exposed simultaneously to both a powerful beam of accelerated electrons 5, or so-called Electron Beam (EB), produced by an Accelerator of Electrons (AE) 6, and to the Electric Discharge field (ED) 8 produced by a high-voltage pulse-frequency generator 7. Both EB and ED are preferably synchronized and driven by a control unit 9, so that they are simultaneously applied to the processed medium in a form of a series of short powerful pulses with a pre-determined frequency (preferably about 300 Hz) and repetition rate;

Step 4. Such combined exposure initiates and maintains cracking reactions in the volume of the heterogeneous medium. The high-energy Electron Beam 5 formed by an Accelerator of Electrons 6 acts as a highly effective initiator of a chain of chemical reactions of cracking, and it performs the following actions:

- Creates desired distribution of the reaction initiation nodes in the exposed heterogeneous medium throughout the reaction chamber;
- Continuously generates free radicals in that medium, as well as secondary electrons, and molecules in unstable excited and over-excited states. During this process, the system is in a state of thermal non-equilibrium as well as spatially non-uniform state, since the newly formed particles create micro areas (a few nano-meters in diameter) along their paths with high local concentration of ionized particles that in turn form droplets, tracks and spherical spurs;
- In the liquid dispersion phase volume, the density of which is three orders of magnitude greater than the gas phase's density, EB loses most of its energy, and thus generates free radicals that support chain reactions in the medium;
- In the gas phase volume, which has low density, EB barely slows down, while causing primary volumetric ionization of the gas. This, in turn, supports the intensive volumetric discharge that is originated by the applied electric field 8.

The speed of initiation of particles either does not depend or sometimes slightly depends on the medium temperature, and is rather easily controlled by varying the absorbed doze of radiation.

Step 5. A series of electric discharges that occur in the medium due to the applied ED field initiates intense generation of free radicals in the chemically-active heterogeneous medium.

Step 6. The radicals created by this discharge come into contact with a large surface area of the liquid dispersion phase, and are absorbed by it. This causes further generation of chain reactions, which in turn open channels of chemical reactions that are impossible in equilibrium conditions.

Powerful discharges are formed by a high voltage pulse-frequency generator 7, which works in synch with the Accelerator of Electrons 6 that produces the Electron Beam 5.

As a result of the above described processes, intense cracking of heavy hydrocarbons takes place in the reaction chamber, which in turn causes formation of light fractions 10 of these hydrocarbons. Produced light hydrocarbon fractions are then brought out of the chamber, separated from the medium by a separator 11, to form the end product 12—separated light fractions of hydrocarbons—which can be further used elsewhere.

An additional useful aspect of the invention is the ability to refine hydrocarbons by removing sulfur therefrom. Sulfur atoms are separated from hydrocarbon molecules during cracking and then combine with hydrogen atoms to form H2S molecules of hydrogen sulphide, which are then easily separated from hydrocarbons using known methods.

Device For Implementing the Method of the Invention

Device adapted to implement the proposed method works preferably in a pulse-frequency mode—this is a very critical and distinct feature of the proposed method. Short pulses with duration being less than one microsecond, but of very high power (a few MWt) allow creation of non-equilibrium and non-stationary conditions for the reacting components. It permits development of chemical reactions that would have been impossible to develop otherwise, i.e. in traditional stationary equilibrium conditions. Repeating of such conditions with a certain periodicity provides required average efficiency of the entire equipment set.

Parameters of the basic processes and features of the main modules of this device are usually chosen based on a particular application and processing objectives, and depending on that they may vary in broad ranges. The following discussion is given as only as a practical illustration and describes a laboratory prototype of the device. Commercial version of the apparatus is assumed to be larger and more powerful:

Average stationary electric power P of the TCP unit usually varies in the range from 10 KWt to 100 KWt.

Required intensity of each individual pulse is mainly determined by physical-chemical characteristics of the input hydrocarbon product. On the one hand, the higher pulse intensity is, the more potential exists for affecting the treated material, first of all by creating non-equilibrium thermal and chemical conditions. On the other hand, greater intensity of pulses might cause some operational problems related to switching of high powers, erosion and deterioration of electrodes, etc. Analysis shows that recommended practical energy capacity per single pulse should not exceed 10 Joules per pulse. Relationships between the power W, pulse duration t, and the pulse energy is determined as E=Wt. For example, if the power is within the range of $10^6$-$10^8$ Wt, the corresponding pulse duration should be from $10^{-5}$ to $10^{-7}$ sec. Pulse repetition rate f establishes relationship between average stationary characteristics of the equipment with its features in the pulse operational mode. For example, for above mentioned parameters' ranges the repetition rate is $10^2<f<10^4$ Hz.

Figure 2:
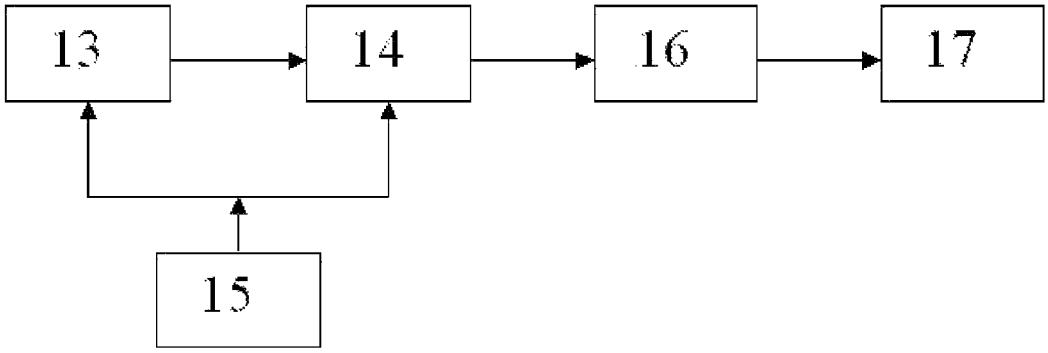
FIG. 2 is functional diagram of the pulse-frequency generator.
Figure 3:
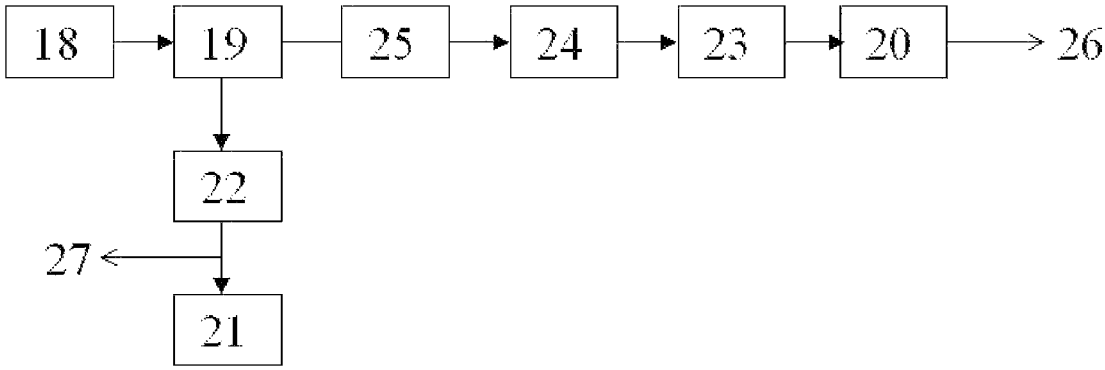
FIG. 3 is a functional diagram of the ultra high frequency power supply system.

Below is a description of a laboratory prototype of the device for implementing a method of the present invention, shown schematically on FIGS. 2 and 3. It has the EB power of about 0.5 MWt, which is achieved with the pulse duration of 3-5 microseconds and the electron energy of 3-4 MeV. With the pulse repetition rate of about 300 Hz, the average power of the EB reaches 1 kWt. The generated beam has a cross-sectional diameter of about 20 mm. It is entered to the reaction chamber, which contains a heterogeneous medium, through a titanic foil. Typical components and parameters of an Accelerator of Electrons that generates EB are described further below.

The electric field, which provides a required electric discharge, is created by pulse-frequency sources. The pulse-frequency source constitutes of a high-voltage pulse generator of the power ~10 MWt (voltage magnitude—up to 20 kV, maximum current in an impulse—up to 750 Amps, with pulse duration of about 150 nanoseconds, at the repetition rate—up to 300 Hz. The structure of the pulse-frequency generator is described in greater detail below.

The two-phase heterogeneous medium used for this example is characterized by a very broad range of densities: in the range from ~1 g/cc (gram per cubic centimeter) to 0.1 g/cc (bubbles in a liquid, streams of liquid in the gas), and from 0.1 to 0.01 g/cc (fluid micro-drops in the gas). The gas phase consists of light hydrocarbons, inertial gases, nitrogen, and atmospheric air under the pressure of 1-3 atmospheres (~14.7 to 44 psi). The liquid dispersion phase consists of heavy hydrocarbons, water and water-based solutions of different chemical compounds, i.e. the medium with varying dielectric permittivity and electric conductivity. The temperature of the liquid dispersion phase varies from room temperature to 500 $K^0$. This multi-phase heterogeneous medium is created by using various barbotage (bubbling) methods, mechanical mixers and nozzles.

The depth of penetration for EB depends on the density of heterogeneous medium, and it varies from 2 to 20 cm. The spatial configuration of the created electric field approximately corresponds to the configuration of the zone directly exposed to the EB. Geometry of the electrodes is also determined by desired local strengthening of the electric field intensity. The electric discharge field vector can be oriented either along or perpendicular to the direction of the EB.

Main Modules: Configuration and Parameters For a Laboratory Prototype of the Device Accelerator of Electrons. The Accelerator of Electrons (AE) is one of the most critical modules of the device. Key technical parameters of AE of a lab prototype are the following (provided for reference only):

| | |
|---|---|
| Energy of accelerated electrons: | 1-10, preferably 3-5 MeV; |
| Peak Current of EB: | up to 100 mA; |
| Pulse Duration: | 3-5 microseconds |
| Pulse Repetition Rate: | 300-500 Hz |
| Average power of EB: | up to 1 kWt |

The EB gets out of vacuum, dissipates at the output titanic foil, then goes through a layer of gas in the module of accidental blowout prevention, then penetrates through the input titanic foil, and finally gets into the container with the treated material (heterogeneous medium).

The Accelerator of Electrons is a linear resonant accelerator, within which a standing wave is formed. Standard functional components of a typical Accelerator of Electrons are the following: electron injector, accelerating system itself, Ultra-High-Frequency (UHF) system power supply, high-voltage pulse power supply, control system, vacuum system, electronegative gas (elegas) system, and a cooling system. The electron injector is a three-electrode electron gun with a spherical oxide cathode. The injection voltage in the lab prototype is 40 V, with the injection current up to 2 Amps. Power of cathode heating system is about 30 W. The focusing electrode is connected to the cathode. The anode of the injector is the front wall of the first accelerating resonator. The crossover of the EB is positioned in the middle of the first accelerating resonator.

The accelerating system is usually designed on the basis of a bi-periodical accelerating structure that works in the S frequency range. It consists of the 11 omega (Ω)-shaped accelerating resonators, including two grouping resonators, and 10 cylindrical connection resonators arranged alternately along the axis of the accelerating structure and connected to each other by means of narrow connection slots. An accelerating resonator usually contains an input wave-guide with a communication window, an antenna for controlling the acceleration field level, and the water-cooling channel.

Pulse-Frequency Generator. The functional diagram of the pulse-frequency generator of high-voltage nanosecond pulses is presented in FIG. 2. The generator is designed on the solid-state elements' basis. It contains a stabilized high-voltage power supply (13), high-voltage solid-state switchboard (14) with a control and synchronization system (15), and two-stage system of magnetic compression of pulses (16) applied then to a load (17). In a preferred configuration, the electric discharge field is applied in synch with the EB in short pulses, each pulse having the ED field on for about 150 nanoseconds, with a discharge voltage of about 20 kV, and a discharge pulse current of about 750 Amps.

UHF power supply system. Block-Diagram of the UHF system is shown in FIG. 3. It includes a magnetron (18), ferrite circulator (19) with three ports for UHF de-coupling, and the accelerating resonator (20), wave guide load (21), and wave guide phase rotator (22), wave guide bent section (23), wave guide unit of the vacuum gas evacuation (24), wave guide window (25), output for the accelerating resonator antenna signal (26), and the output (27) in the phase rotator for controlling the reflected signal that occur in the power supply system.

The UHF system works in an auto-generation mode. Thus the magnetron feedback loop is realized via the following circuit: magnetron, incoming wave in the wave guide from the magnetron to the accelerating resonator, the accelerating resonator, a reflected wave in a wave guide coming from the accelerating resonator, circulator, phase rotator, magnetron. Inclusion of the high-Q accelerating resonator with the loaded Q factor of about 7000 in the auto-generation loop of the magnetron provides noticeable (in the order of magnitude) improvement in the generated frequency stability. The system of the high-voltage power supply provides high-voltage to the magnetron, filament for magnetron, high-voltage to the injector, and filament for injector.

The vacuum system includes an oil-free rotational pump, turbo-molecular pump, ionic pump, two thermal pair pressure sensors, and the system of vacuum tubes and valves. The elegas system is intended for injecting the elegas into the gas-filled section of the wave with the pressure of up to 2 bar, in order to increase its electric isolation. The system of cooling is intended for cooling of magnetron.

Reaction Chamber. Reaction Chamber of the device consists of a cylindrical cap and the flat bottom, on which all main functional elements are mounted. Volume under the cap is about 50 liters. It defines the full quantity of the gas phase for processing. Working pressure in the chamber is no more than 3 Atmospheres, and it's possible to create vacuum up to ~0.1 torr (1 torr=133 Pa). Under the bottom of the container chamber, there is located a working chamber, in which a gas-dispersion liquid mixture is created by using electro-mechanical mixers or by other means. This heterogeneous medium is then exposed to EB and, respectively, treated in the same chamber. The EB is entered into the container through a window with a titanic foil. Depending on the average density of the mixture, electrons with the energy E equals about 4 MeV are absorbed in the container at the length from ~20 mm to 100 mm.

During the course of processing, the reaction chamber is kept very hermetic, so that the liquids and gases loaded into the chamber don't leave it during this period. Cooling of the chamber is done naturally, by the surrounding air. The maximal weight of a liquid loaded into the chamber (for the lab prototype device) is about 1 kg.

The same conceptual method and device can be reversed and applied to unify light fractures of hydrocarbons into a heavy hydrocarbon. In this case, light fractions are first supplied to the reaction chamber and mixed with a separately supplied hydrogen-containing gas. The medium is then mixed in the same manner as for the cracking method of the invention to form a heterogeneous medium with at least a gas phase and a liquid phase, the liquid being dispersed and mixed with the gas phase. The chamber and the medium are then exposed to both the EB and ED in the manner described above to initiate and maintain chain reactions of conversion of light fractions into a heavy hydrocarbon, which is then separated from the medium and constitutes the output product of the process.

Specific parameters for such unification process are adjusted for each specific application but generally include the following appropriate ranges:

| | |
|---|---|
| EB energy | 1-10 MeV; |
| Exposure time | 0.1-10 seconds |
| Energy absorption of heterogeneous medium | 1-100 kGy |
| Rate of energy absorption | 1-100 kGy/sec |

Although the invention herein has been described with respect to particular embodiments, it is understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for cracking a heavy hydrocarbon into its light fractions comprising the steps of:

(a) providing a heavy hydrocarbon in a closed chamber;

(b) injecting a hydrogen-containing gas into said chamber;

(c) mixing said heavy hydrocarbon with said hydrogen-containing gas to form a heterogeneous medium comprising at least a gas phase and a liquid dispersion phase interspersed therewith, said heterogeneous medium evenly dispersed throughout said chamber;

(d) exposing said medium in said chamber at the same time to both an electron beam and an electric discharge field to initiate and maintain chain reactions of cracking in said heavy hydrocarbon, said chain reactions of cracking causing formation of light fractions from said heavy hydrocarbon; and (e) separating said light fractions from said medium.

2. The method as in claim 1, wherein said heavy hydrocarbon includes coal.

3. The method as in claim 2, wherein said coal is provided in a powdered form.

4. The method as in claim 1, wherein said heavy hydrocarbon is oil.

5. The method as in claim 1, wherein said heavy hydrocarbon is a liquid with a boiling temperature of at or above about 350 degrees Celsius.

6. The method as in claim 1, wherein said heavy hydrocarbon has a molecular structure including more than 20 atoms of Carbon.

7. The method as in claim 1, wherein said light fractions are characterized by a boiling temperature of below about 350 degrees Celsius.

8. The method as in claim 1, wherein said light fractions are characterized by having a molecular structure including between 5 and 20 atoms of Carbon.

9. The method as in claim 8, wherein said light fractions are further characterized by a boiling temperature of below about 350 degrees Celsius.

10. The method as in claim 1, wherein said hydrogen-containing gas is selected from a group consisting of hydrogen or methane.

11. The method as in claim 1, wherein said electron beam having its energy level from about 1 MeV to about 10 MeV.

12. The method as in claim 1, wherein said electron beam is applied in step (d) in pulses with a first frequency of about 300 Hz and duration of application during each pulse of about 3 to 5 microseconds.

13. The method as in claim 1, wherein said electric discharge field is applied in step (d) in pulses with a second frequency of about 300 Hz.

14. The method as in claim 13, wherein said electric discharge field is applied during each pulse for about 150 nanoseconds.

15. The method as in claim 1, wherein said electron beam and said electric discharge field are applied in step (d) with the same frequency and synchronously.

16. The method as in claim 1, wherein said electric discharge field is characterized by a discharge voltage of about 20 kV.

17. The method as in claim 16, wherein said electric discharge field is further characterized by a discharge pulse current of about 750 Amps.

18. The method as in claim 1, wherein said step (d) further including creating a predetermined plurality of spaced apart initiation points in which said chain reactions of disassociation first take place, said initiation points having locations throughout said chamber as defined by said electron beam.

19. The method as in claim 1, wherein said step (d) further including production of free radicals and ions and maintaining chain reactions in said medium by said electric discharge field.

20. The method as in claim 1, wherein said step (d) further includes separation of sulfur from said heavy hydrocarbon, combining said sulfur with hydrogen to form hydrogen sulphide, and separating said hydrogen sulfide from said medium to achieve refining said hydrocarbons.

21. A method for unification of light hydrocarbon fractions into a heavy hydrocarbon comprising the following steps:

(a) providing light hydrocarbon fractions in a closed chamber;

(b) injecting a hydrogen-containing gas into said chamber;

(c) mixing said fractions with said hydrogen-containing gas to form a heterogeneous medium comprising at least a gas phase and a liquid dispersion phase interspersed therewith, said heterogeneous medium evenly dispersed throughout said chamber;

(d) exposing said medium in said chamber at the same time to both an electron beam and an electric discharge field to initiate and maintain chain reactions of conversion of said light hydrocarbons into said heavy hydrocarbon; and (e) separating said heavy hydrocarbon from said medium.

22. The method as in claim 21, wherein said electron beam having its energy level from about 1 MeV to about 10 MeV.

23. The method as in claim 21, wherein said step (d) is further characterized by having exposure time between about 0.1 second to about 10 seconds.

24. The method as in claim 21, wherein said step (d) is further characterized by energy absorption of said medium ranging from about 1 kGy to about 100 kGy.

25. The method as in claim 21, wherein said step (d) is further characterized by controlling the rate of energy absorption in said medium within a range from about 1 to about 100 kGy/sec.

* * * * *